US008292590B2

(12) United States Patent
Leneweaver

(10) Patent No.: US 8,292,590 B2
(45) Date of Patent: Oct. 23, 2012

(54) ENGINE COMPONENTS AND ROTOR GROUPS

(75) Inventor: Mark Leneweaver, Chandler, AZ (US)

(73) Assignee: Honeywell International Inc.

( * ) Notice: Subject to any disclaimer, the term of this patent is extended or adjusted under 35 U.S.C. 154(b) by 1473 days.

(21) Appl. No.: 12/106,733

(22) Filed: Apr. 21, 2008

(65) Prior Publication Data

US 2009/0263253 A1 Oct. 22, 2009

(51) Int. Cl.
*F04D 29/20* (2006.01)

(52) U.S. Cl. ..... 416/204 A; 416/244 A

(58) Field of Classification Search ..... 416/244 A, 416/204 A, 224; 415/216.1
See application file for complete search history.

(56) References Cited

U.S. PATENT DOCUMENTS

| | | | | |
|---|---|---|---|---|
| 3,591,308 | A | 7/1971 | Blattner | |
| 3,884,595 | A | 5/1975 | Herrick | |
| 4,697,987 | A | 10/1987 | Katayama et al. | |
| 6,481,917 | B1 * | 11/2002 | Chen et al. | 416/244 A |
| 6,481,970 | B2 * | 11/2002 | Mukherjee et al. | 416/244 A |
| 7,251,887 | B2 | 8/2007 | Tench, Jr. et al. | |
| 2006/0080832 | A1 | 4/2006 | Yip et al. | |

FOREIGN PATENT DOCUMENTS

| | | | |
|---|---|---|---|
| JP | 56159600 A | * | 12/1981 |
| JP | 58217702 A | * | 12/1983 |
| JP | 59018201 A | * | 1/1984 |

* cited by examiner

*Primary Examiner* — Richard Edgar
(74) *Attorney, Agent, or Firm* — Ingrassia Fisher & Lorenz, P.C.

(57) ABSTRACT

Engine components and rotor groups are provided. In an embodiment, by way of example only, an engine component includes an impeller and a protective sleeve. The impeller has a bore defined by an inner surface. The protective sleeve lines the inner surface of the impeller and comprises a polymer material. In another embodiment, by way of example only, a rotor group includes an impeller, a protective sleeve, a rotor component, and a tie shaft. The impeller has a first bore defined by an inner surface. The protective sleeve lines the inner surface of the impeller and comprises a polymer material. The rotor component has a second bore, and the tie shaft extends through the first bore and the second bore.

15 Claims, 3 Drawing Sheets

ENGINE COMPONENTS AND ROTOR GROUPS

TECHNICAL FIELD

The inventive subject matter generally relates to engines, such as auxiliary power units, and more particularly relates to components and rotor groups for use in auxiliary power units.

BACKGROUND

In many aircraft, main propulsion engines not only provide propulsion for the aircraft, but may also be used to drive various other rotating components such as, for example, generators, compressors, and pumps, to thereby supply electrical and/or pneumatic power. However, when an aircraft is on the ground, its main engines may not be operating. Moreover, in some instances the main propulsion engines may not be capable of supplying the power needed for propulsion as well as the power to drive these other rotating components. Thus, many aircraft include an auxiliary power unit (APU) to supplement the main propulsion engines in providing electrical and/or pneumatic power. An APU may also be used to start the propulsion engines.

An APU is typically a gas turbine engine that includes a combustion section, a power turbine section, and a compressor section. During operation of the APU, the compressor section draws in and compresses ambient air and supplies the air to the combustion section. Fuel is injected into the compressed air within the combustion section to produce the high-energy combusted air to the power turbine section. The power turbine section rotates to drive a generator for supplying electrical power, via a main shaft, and to drive its own compressor section and/or an external load compressor.

Although the aforementioned APU is generally safe and robust, certain aspects, in particular, the assembly and repair of the APU, may be improved. In one example, one or more sections of the APU may be made up of rotor groups that include one or more rotatable components (e.g., impellers and turbines) coupled to each other via a tie shaft. The tie shaft extends through bores formed through an axial length of each component and generally has a flanged end against which one component rests, a length onto which the components are mounted, and a threaded end to which a nut is mated to maintain the components on the tie shaft. During assembly or repair of the rotor group, the tie shaft may be may be repeatedly moved into and out of the bores. In some cases, if the threaded end inadvertently contacts the rotatable component, a scratch may form thereon. As a result, the useful life of the rotatable component may be reduced, which may increase a frequency of maintenance of the APU. In cases in which the scratch has dimensions that exceed an acceptable tolerance, the rotatable component may be discarded.

Accordingly, it is desirable to have a rotatable component (e.g., an impeller and/or turbine) that has an improved useful life, as compared to conventional rotatable components. In addition, it is desirable to decrease the frequency of maintenance of the APU that includes the rotatable component. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Engine components and rotor groups are provided.

In an embodiment, by way of example only, an engine component includes an impeller and a protective sleeve. The impeller has a bore defined by an inner surface. The protective sleeve lines the inner surface of the impeller and comprises a polymer material.

In another embodiment, by way of example only, a rotor group includes an impeller, a protective sleeve, a rotor component, and a tie shaft. The impeller has a first bore defined by an inner surface. The protective sleeve lines the inner surface of the impeller and comprises a polymer material. The rotor component has a second bore, and the tie shaft extends through the first bore and the second bore.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

Figure 1:
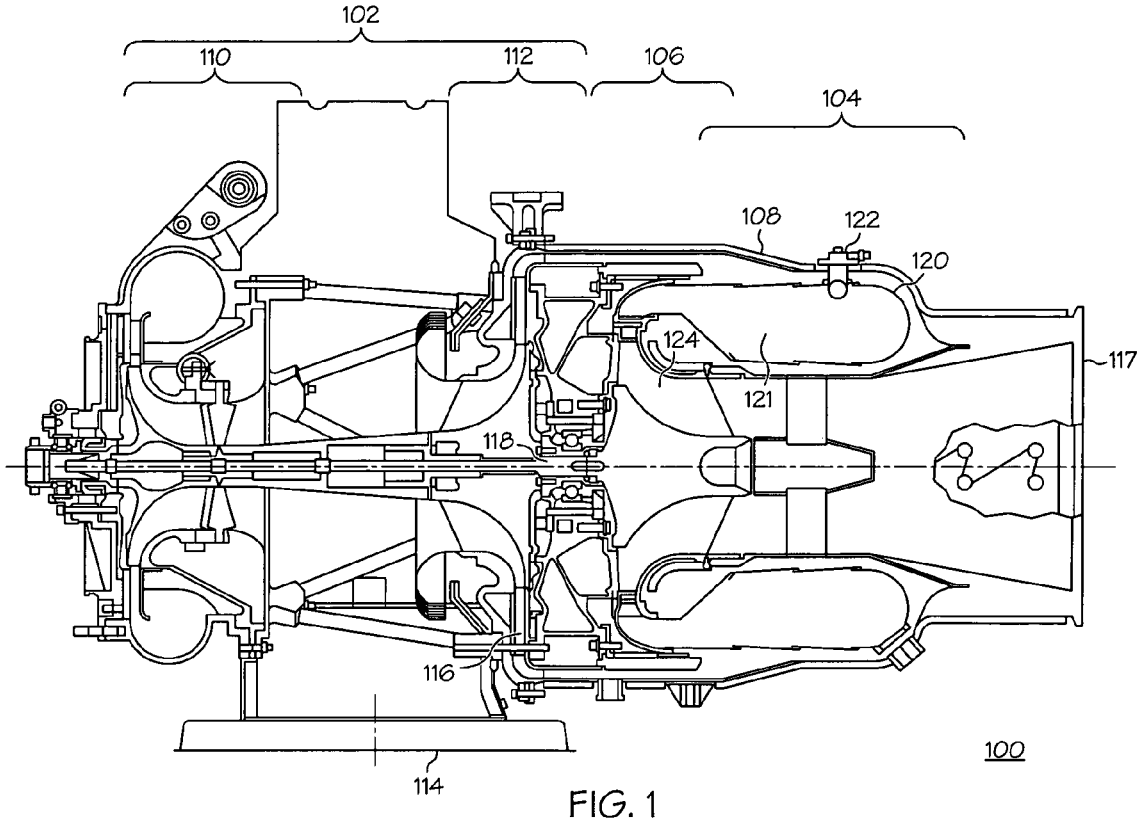
FIG. 1 is a cross section view of an auxiliary power unit, according to an embodiment.

FIG. 1 is a cross section view of an auxiliary power unit (APU), according to an embodiment. In an embodiment, the APU 100 includes a compressor section 102, a combustor section 104, and a turbine section 106, each of which is disposed within a case 108. The compressor section 102 includes a load compressor 110 and an engine compressor 112. The load compressor 110 and the engine compressor 112 receive air from an air inlet 114, and the two compressors 110, 112 cooperate to raise the pressure of the air to a desired level. The compressors 110, 112 both may be high-pressure ratio centrifugal compressors, in an embodiment. In another embodiment, the compressors 110, 112 may be different from each other. For example, the load compressor 110 may be a high-pressure ratio centrifugal compressor and the engine compressor 112 may be another type of compressor. In another example, both the load compressor 110 and the engine compressor 112 may not be high-pressure ratio centrifugal compressors and may alternatively be other types of compressors.

In any event, the engine compressor 112 fluidly communicates with a diffuser 116, which directs the compressed air into the combustor section 104. The diffuser 116 is configured to inject the compressed air into the combustor section 104 in a substantially uniform manner. The combustor section 104 includes a combustor 120 defining a chamber 121 that receives the diffused air. One or more fuel injectors 122 supply fuel to the chamber from a fuel source (not shown), and the compressed air mixes with the fuel and is combusted to generate a high-energy gas. The high-energy gas is then diluted and supplied to the turbine section 106.

The turbine section 106 includes one or more turbines 124 that may be divided into high pressure, low pressure, and intermediate pressure turbines, in some embodiments. Although one turbine is shown in FIG. 1, more may be included in other embodiments. A portion of the high-energy gas impinges the turbine 124 to cause rotation thereof. As the turbine 124 rotates, it drives a main shaft 118, which as a result, drives various types of equipment that may be mounted in, or coupled to, the engine 100. For example, in the depicted embodiment, the rotating turbine 124 drives the compressors 110, 112. In other examples, the main shaft 118 may be coupled to a main generator (not shown) and/or other rotational equipment, and the rotating turbine 124 may be used to drive those components. The gas may then be exhausted from the APU 100 via an exhaust gas outlet 117.

Figure 2:
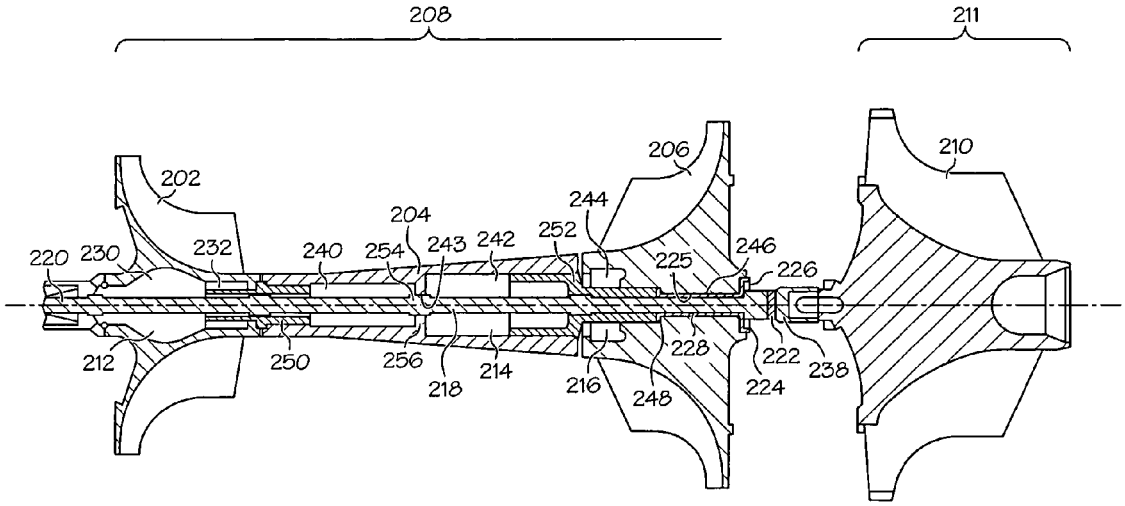
FIG. 2 is a cross section view of a rotor group, according to an embodiment.

As alluded to above, the sections 102 and 104 are coupled together via the main shaft 118. In an embodiment, the main shaft 118 may be made up of two or more subassemblies and each subassembly may include at least one rotor group. FIG. 2 is a cross-section view of a portion of the main shaft 118 including a rotor group 200, according to an embodiment. The rotor group 200 may include engine components, such as a load compressor impeller 202, a rotor component 204, and an engine compressor impeller 206, which may be implemented as part of a compressor section 208, a turbine wheel 210, which may be included as part of a turbine section 211, and a tie shaft 218. In other embodiments, the rotor group 200 may include additional components, such as one or more additional rotor components, turbines or other rotatable components, or may include fewer components.

In any case, the load compressor impeller 202, the rotor component 204, and the engine compressor impeller 206 may each include bores 212, 214, 216 that are formed axially therethrough. The term "bore" as used herein may be defined as an elongated hole. The load compressor impeller bore 212 is shown in this embodiment as including two sections 230, 232. According to an embodiment, both sections 230, 232 have diameters that are at least as larger as a diameter of the tie shaft 218. In another embodiment, the first section 230 may have a diameter that is larger than the diameter of the second section 232. For example, the first section 230 may have a diameter in a range of about 2.2 cm to about 4.0 cm, while the second section 232 may have a diameter in a range of about 1.24 cm to about 1.30 cm. Additionally, the first section 230 may have an axial length that is substantially equal (e.g., within 0.5 cm) to an axial length of the second section 232. In one example, the first section 230 may have an axial length in a range of about 3.58 cm to about 3.71 cm, while the second section 232 may have an axial length in a range of about 4.12 cm to about 4.20 cm. In another embodiment, the first section 230 may have an axial length that is substantially different (e.g., greater than 5 cm) from the second section 232. For example, the first section 230 may have an axial length in a range of between about 5.1 cm to about 6.9 cm, and the second section 232 may have an axial length in a range of between about 0.5 cm to about 2.3 cm. In still other embodiments, the diameters and axial lengths may be smaller or larger than the aforementioned ranges. In yet other embodiments, the load compressor impeller bore 212 may include more than two sections having varying diameters and axial lengths, or the load compressor impeller bore 212 may have a substantially uniform diameter along its entire axial length.

As shown in FIG. 2, the rotor component bore 214 may have varying bore diameters that are at least as large as a diameter of the tie shaft 218. For instance, the rotor component bores 214 may have a first section 240 and a second section 242 joined together by a third section 243, where each section 240, 242, 243 has a varying diameter. In an embodiment, the first section 240 of the rotor component bore 214 may have a relatively smaller diameter than a largest diameter of the second section 242, and may be in a range of between about 2.2 cm to about 2.3 cm. The second section 242 of the rotor component bore 214 may have a relatively larger diameter than the first section 240 and may have a diameter in a range of between about 3.40 cm to about 3.42 cm. The third section 243 may be smaller than both the first and second sections 240, 242 and may have a diameter in a range of between about 1.12 cm to about 1.13 cm. The axial lengths of each section 240, 242, 243 of the rotor component bore 214 may depend on a particular axial length of the surrounding components. In an embodiment, the axial length of the first section 240 with the smaller diameter may be in a range of between about 5.3 cm to about 5.5 cm. The axial length of the second section 242 with the larger diameter may be in a range of between about 4.5 cm to about 4.7 cm. The axial length of the third section 243 may be in a range of between about 0.017 cm to about 0.5 cm. In another embodiment, the rotor component bore 214 may be substantially uniform in diameter along its axial length.

The engine compressor impeller bore 216 is shown in this embodiment as including two sections 244, 246. According to an embodiment, both sections 244, 246 have diameters that are at least as larger as a diameter of the tie shaft 218. In another embodiment, the first section 244 may have a diameter that is larger than the diameter of the second section 246. For example, the first section 244 may have a diameter in a range of about 1.9 cm to about 2.0 cm, while the second section 246 may have a diameter in a range of about 1.2 cm to about 1.3 cm. Additionally, the first section 244 may have an axial length that is substantially equal (e.g., within 0.5 cm) to an axial length of the second section 246. In one example, the first section 244 may have an axial length in a range of about 3.6 cm to about 3.7 cm, while the second section 246 may have an axial length in a range of about 4.0 cm to about 4.3 cm. However, in other embodiments, the diameters and axial lengths may be smaller or larger than the aforementioned ranges. In other embodiments, the engine compressor impeller bore 216 may include more than two sections having varying diameters and axial lengths, or the engine compressor impeller bore 216 may have a substantially uniform diameter along its entire axial length.

As alluded to above, the rotor group 200 is tied together by the tie shaft 218. The tie shaft 218 makes up a portion of the main shaft 118 (FIG. 1) and has a threaded end 220 and a spline end 222, in an embodiment. The threaded end 220 includes threading adapted to mate with threading on a corresponding nut (not shown) that secures the rotor group 200 in axial position on the tie shaft 218. The spline end 222 may be adapted to correspond with an internal spline in a coupling 238 that is used to couple the tie shaft 218 to the turbine wheel 210.

In an embodiment, to further secure the tie shaft 218 to the rotor group 200, inserts 250, 252 may be included therebetween. For example, a load compressor insert 250 may be mounted to a portion of the tie shaft 218 intended to be received within the load compressor impeller bore 212 and the rotor component bore 214. In this regard, the load compressor insert 250 may extend therebetween and may have sections including outer diameters that correspond with the diameters of the load compressor impeller bore 212 and the rotor component bore 214 such that the insert 250 may be press fit into the bores 212, 214. In another example, an engine compressor insert 252 may be mounted to a portion of the tie shaft 218 intended to be received within the engine compressor impeller bore 216 and the rotor component bore 214. In this regard, the engine compressor insert 252 may extend therebetween and may have sections including outer diameters that correspond with the diameters of the engine compressor impeller bore 216 and the rotor component bore 214 such that the insert 252 may be press fit in the bores 216, 214. In yet another example, the tie shaft 218 may include a radially outwardly extending engagement flange 254 that is integrally formed as part of or mounted thereon to engage with a mating flange 256 that extend radially inwardly from an inner surface of a rotor group component, such as the rotor component 204 in an embodiment. In other embodiments, the mating flange 256 may extend radially from a different component and the engagement flange 254 may extend radially outwardly from a different location on the tie shaft 218.

During assembly, the threaded end 220 is inserted through the engine compressor impeller bore 216, the rotor component bore 214, and the load compressor impeller bore 212, and the position of the tie shaft 218 is adjusted. To protect the engine compressor impeller 206 from contact with the threaded end 220, a protective sleeve 228 may line an inner surface 225 of the engine compressor impeller 206. The inner surface 225 may define at least a portion of the engine compressor impeller bore 216. As mentioned above, the protective sleeve 228 is disposed in the engine compressor impeller bore 216. In an embodiment, the protective sleeve 228 may extend an entire axial length of the engine compressor impeller bore 216. In other embodiments, the protective sleeve 228 extends through a section of the engine compressor impeller bore 216 having a smallest diameter, such as, for example, the second section 246.

The protective sleeve 228 may have an outer diameter that is the same as or slightly smaller than the diameter of the engine compressor impeller bore 216 and may have a thickness such that an inner diameter of the sleeve 228 is sufficiently sized to accommodate an outer diameter of the tie shaft 218. In an embodiment, the protective sleeve 228 has an outer diameter that is in a range of between about 1.242 cm to about 1.244 cm. The thickness of the protective sleeve 228 may be in a range of between about 0.036 cm to about 0.038 cm. However, it will be appreciated that the particular dimensions of the protective sleeve 228 may depend on the particular dimensions of the engine compressor impeller bore 216 and the tie shaft 218.

In any case, to protect the engine compressor impeller 206 without damaging the tie shaft 218, the protective sleeve 228 is made of a polymeric material that is capable of maintaining structural integrity upon exposure to temperatures in a range of between about −50° C. to about 200° C., in an embodiment. Suitable polymeric materials include, but are not limited to fluoropolymer materials, such as polytetrafluoroethylene, polyamide materials, such as nylons, and the like.

Figure 3:
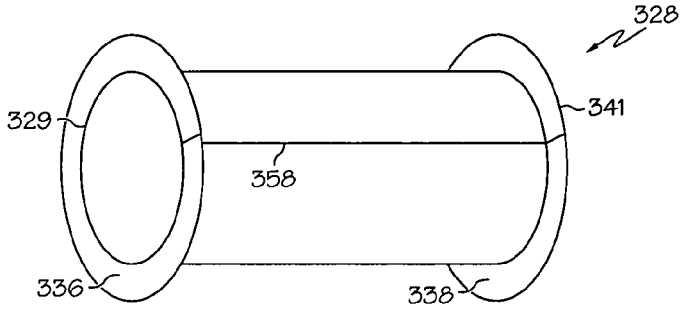
FIG. 3 is a cross section view of a protective sleeve, according to an embodiment.
Figure 4:
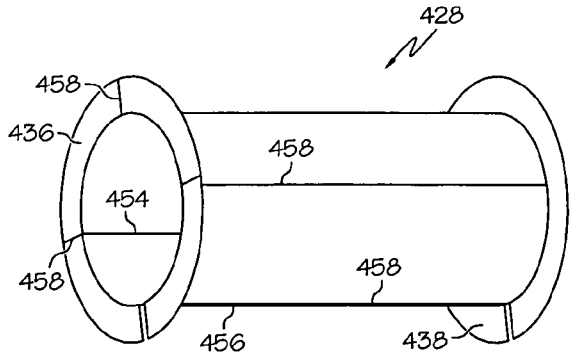
FIG. 4 is a cross section view of a protective sleeve, according to another embodiment.

FIGS. 3 and 4 illustrate protective sleeves 328, 428, according to two embodiments. Referring first to FIG. 3, the protective sleeve 328 includes a first flange 336 and a second flange 338. The first flange 336 extends radially outwardly from a first end 329 of the sleeve 328 and has an outer diameter that is greater than a diameter of the load compressor impeller bore 216 (FIG. 2) so that it may be disposed against a surface of the impeller defining an inlet to a section of the engine compressor impeller bore 216 having a smallest diameter. For example, the first flange 336 may be disposed against a surface defining an inlet into the second section 246 (FIG. 2) of the engine compressor impeller bore 216. In an embodiment, the first flange 336 has a largest diameter that is greater than a diameter of the second section 246, and thus rests again a surface 248 (FIG. 2) that defines an inlet to the bore second section 246. In another embodiment in which the engine compressor impeller bore 216 has a substantially uniform diameter, the first flange 336 may have a largest diameter that is greater than a diameter of the engine compressor impeller bore 216. In either case, the largest diameter of the first flange 336 may in a range of between about 1.52 cm and about 1.89 cm larger than the diameter of the engine compressor impeller bore 216. The second flange 338 extends radially outwardly from a second end 341 of the sleeve 328 and also has an outer largest diameter that is greater than a diameter of the engine compressor impeller bore 216. Similar to the first flange 336, the largest diameter of the second flange 338 may in a range of between about 1.52 cm and about 1.89 cm larger than the diameter of the engine compressor impeller bore 216; however, the diameters of the two flanges 336, 338 may be unequal, in an embodiment. In another embodiment, the diameters of the two flanges 336, 338 may be equal. Additionally, although the flanges 336, 338 appear to have an oval shape, the flanges 336, 338 may have alternative shapes, such as circular, rectangular, square, and the like, or may include one or more radially-extending tabs. Moreover, although two flanges 336, 338 are shown in the illustrated embodiment, a single flange, either the first flange 336 or the second flange 338, may be alternatively included in other embodiments.

The protective sleeve 328 includes one or more slits 358 (only one of which is shown in FIG. 3) that may extend through the first and/or second flanges 336, 338 along an axial length of sleeve 328. Slits 358 may be configured to ease insertion of the sleeve 328 into the engine compressor bore 216, according to an embodiment. In particular, the slits 358 may be included to allow an end (one or both of the first end 329 and/or the second end 341 of the sleeve 328) to be compressed to a diameter that is smaller than the diameter of the engine compressor impeller bore 216. In an embodiment, the one or more slits 358 may extend an entire axial length of the protective sleeve 328 and through each of the flanges 336, 338, as shown in FIG. 3.

FIG. 4 is a perspective view of a protective sleeve 428, according to another embodiment. Here, the sleeve 428 includes a plurality of slits 458 that extend from a first flange 436 along a portion of the axial length of the sleeve 428 partially to the second flange 438. In an embodiment, the slits 458 extend through the first flange 436 and from the first flange 436 approximately halfway along the axial length toward the second flange 438. In other embodiments, the slits 458 may be longer or shorter. The slits 458 may be evenly spaced around a circumference of the sleeve 428, in an embodiment, or alternatively, the slits 458 may be disposed unevenly around the circumference of the sleeve 428. Additionally, although four slits 458 are shown, fewer or more may alternatively be included. In an embodiment, the slits 458 may include cuts 454 made through the protective sleeve 428. In another embodiment, the slits 458 may be formed as axially-extending gaps 456 (shown in phantom) in the protective sleeve 428. The slits 458 may be made up of only cuts 454, only axially-extending gaps 456, or both.

Referring to FIGS. 2-4, by including a protective sleeve 228, 328, 428 in the engine compressor impeller bore 216, a threaded end of a tie shaft may be inserted at any point during assembly or disassembly into the bore 216 without damaging an inner surface of the impeller. For example, the protective sleeve 228, 428 may be positioned in the impeller bore 216 before assembly of the rotor group 200 so that the tie shaft 218 may be inserted through the bore 216. The protective sleeve 228, 328, 428 may be remain in the bore 216, even after the rotor group 200 is assembled so that in the event the rotor group 200 may undergo disassembly, the tie shaft 218 may be removed without damaging the impeller 206. Thus, the protective sleeve 228, 328, 428 may improve the useful life of the impeller 206, as compared to conventional impellers, and also may decrease the frequency of maintenance of the impeller 206.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. An engine component, comprising:

an impeller having a bore defined by an inner surface, the bore extending between a first end and a second end and having a first section and a second section, the first section having a first diameter and the second section having a second diameter that is less than the first diameter; and a protective sleeve disposed in the second section and lining the inner surface of the impeller, the protective sleeve comprising a polymer material and including a first end having a first flange extending radially outwardly therefrom and a second end having a second flange extending radially outwardly therefrom, the first flange disposed against a surface of the impeller that defines an inlet to the second section of the bore.

2. The engine component of claim 1, wherein the protective sleeve comprises a fluoropolymer material.

3. The engine component of claim 1, wherein the protective sleeve comprises a polyamide.

4. The engine component of claim 1, wherein the protective sleeve includes a slit extending along at least a portion of an axial length of the protective sleeve.

5. The engine component of claim 4, wherein the slit includes a cut in the protective sleeve.

6. The engine component of claim 4, wherein the slit forms an axially-extending gap in the protective sleeve.

7. The engine component of claim 1, wherein the protective sleeve includes an axial slit extending from a first end of the protective sleeve along a portion of an axial length of the protective sleeve.

8. The engine component of claim 1, wherein the protective sleeve includes an axial slit extending from a first end of the protective sleeve to a second end of the protective sleeve.

9. The engine component of claim 1, wherein the protective sleeve includes a plurality of axial slits extending from the first end of the protective sleeve along a portion of an axial length of the protective sleeve.

10. A rotor group comprising:

an impeller having a first bore defined by an inner surface, the first bore extending between a first end and a second end and having a first section and a second section, the first section having a first diameter and the second section having a second diameter that is less than the first diameter;

a protective sleeve disposed in the second section and lining the inner surface of the impeller, the protective sleeve comprising a polymer material and including a first end having a first flange extending radially outwardly therefrom and a second end having a second flange extending radially outwardly therefrom, the first flange disposed against a surface of the impeller that defines an inlet to the second section of the first bore;

a rotor component having a second bore; and a tie shaft extending through the first bore and the second bore.

11. The rotor group of claim 10, wherein the protective sleeve comprises a fluoropolymer material.

12. The rotor group of claim 10, wherein the protective sleeve comprises a polyamide material.

13. The rotor group of claim 10, wherein the protective sleeve includes a slit extending along at least a portion of an axial length of the protective sleeve.

14. The rotor group of claim 10, wherein the slit includes a cut in the protective sleeve.

15. The rotor group of claim 10, wherein the slit forms an axially-extending gap in the protective sleeve.

* * * * *